United States Patent [19]

McFee

[11] 4,402,193

[45] Sep. 6, 1983

[54] DUAL OPEN CYCLE HEAT PUMP AND ENGINE

[76] Inventor: Richard McFee, R.D. 1, Union Springs, N.Y. 13160

[21] Appl. No.: 290,101

[22] Filed: Aug. 4, 1981

Related U.S. Application Data

[62] Division of Ser. No. 146,600, May 5, 1980, Pat. No. 4,326,388.

[51] Int. Cl.[3] ..... F25D 5/00

[52] U.S. Cl. ..... 62/304; 62/347

[58] Field of Search ..... 62/121, 314, 304, 347, 62/348, 311; 239/25

[56] References Cited

U.S. PATENT DOCUMENTS

| | | | |
|---|---|---|---|
| 2,968,164 | 1/1961 | Hanson | 62/304 X |
| 3,257,815 | 6/1966 | Brocoff et al. | 62/347 X |
| 3,427,816 | 2/1969 | Hanny et al. | 62/347 X |
| 3,670,520 | 6/1972 | Bonteil | 62/347 |

*Primary Examiner*—Lloyd L. King

*Attorney, Agent, or Firm*—Kenyon & Kenyon

[57] ABSTRACT

The heat pump/engine operates in an open cycle between a cold air reservoir and a hot air reservoir to pump heat or to obtain energy by exchanging air at atmospheric pressure between the two reservoirs at different temperatures.

The heat pump/engine employs a positive displacement compressor, heat exchanger and a positive displacement expander to transfer the air flows. Also, a snowmaker preheater can be used with the heat pump to decrease power consumption.

5 Claims, 3 Drawing Figures

DUAL OPEN CYCLE ENGING

DUAL OPEN CYCLE HEAT PUMP

DUAL OPEN CYCLE HEAT PUMP AND ENGINE

This is a division of application Ser. No. 146,600, filed May 5, 1980, now U.S. Pat. No. 4,326,388.

This invention relates to a dual open cycle heat pump. More particularly, this invention relates to a heat pump-/engine which operates between two masses of fresh air at atmospheric pressure and at different temperatures while using the air as a working medium.

As is known, various types of thermal machines have been used to convert temperature differences into mechanical energy, e.g. engines, or vice versa, e.g. heat pumps. For example, the known Freon type heat pumps generally accept heat at an evaporator through which air is blown (and chilled) and reject heat at a condenser through which air is also blown (and heated). However, the work required to transfer a given amount of heat with these devices is of the order of 3 to 10 times the theoretical minimum. This poor performance is due in large part to the relatively large temperature differences (e.g. 10° K.) which exist between the Freon in the heat exchangers and the air circulating through them.

It is well known that buildings heated or cooled by heat pumps must be properly sealed so as to prevent infiltrating air from reducing the temperature difference which the heat pump is striving to create. At the same time, it is desirable to have at least one air change per hour in residences and 2 to 20 air changes per hour in office buildings, schools, stores, theatres, and factories in order to flush out objectionable odors and to prevent the build-up of poisonous gases. The latter include carbon monoxide from stoves, carbon tet from cleaning operations, formaldehyde vapor from foam insulation, mercury vapor from spilled mercury, and the like. In well sealed homes and buildings, explicit ventilation systems are usually installed. These units often include means to exchange heat between incoming and outgoing air streams to as to reduce the load on the heating-/cooling system caused by the ventilation. These exchangers generally reduce the extra thermal load caused by the explicit ventilation to about half what the load would be without the exchanger. Even so, the load is substantial and the cost of the load as well as the cost of the ventilating equipment with exchangers is not small.

It is also known to use solar collectors as sources of heat energy. In the most inexpensive and reliable units of this type, heat is usually carried away from a number of heat collector units by circulating air at atmospheric pressure through the collectors. However, even with air type solar collectors having a modest focusing ability, the temperature of the hot air is only of the order of 400° K. If the heat collected is used to operate an engine with an ambient temperature of 300° K., the maximum (Carnot) efficiency is (400-300)/400 or 25%. Largely because of substantial temperature differences in the evaporator and condenser, efficiencies obtainable with Freon type engines (as well as in engines using ammonia, propane, and the like) are of the order of one quarter of this maximum, i.e. 6%.

The dual open cycle heat pump/engine is closely related to, but not identical to the regenerative Brayton cycle. Many texts on heat machines discuss the Brayton cycle (e.g. chapters 11 and 17 in "Basic Thermodynamics", B. Skrotski, McGray-Hill, 1963). This cycle consists of an adiabatic compression followed by a constant pressure heating, an adiabatic expansion and then a constant pressure cooling, accomplished in closed cycle Brayton machines by a gas circulating around a loop consisting of a compressor, heater, expander and cooler. In simple open cycle Brayton engines ("jet engines"), the gas is air and the entire atmosphere is used as a cooler and, heating is done in a pressurized combustor into which fuel is injected and burned. However, stationary forms of the simple Brayton cycle do not have good efficiency and are not usually seen in commercial equipment. A Brayton engine is described in U.S. Pat. No. 4,077,221. A Brayton heat pump using a radial arrangement of compressors and expanders is described in U.S. Pat. Nos. 2,310,520 and 2,328,439.

Simple Brayton type engines feature circulating flow through a compressor, heater, expander, and cooler. Efficiency can be much improved by employing a low pressure ratio and by using the heat in the hot exhaust of the expander to warm the gas issuing from the compressor prior to entry of the gas into the heater. This requires an extra heat exchanger (regenerator or recouperator). This "regenerative Brayton" type of engine is used, in open cycle gas turbine form, to produce electric power and may soon be widely used as a prime mover for vehicles and boats, as is discussed in "ERDA Automotive GAS Turbine Program", C. S. Chen, p.10 of the 1977 proceedings of the International Energy Conversion Engineering Conference (IECEC). In these engines, the gas in the heater (combustor) is pressurized.

Accordingly, it is an object of the invention to provide a heat pump which approaches the maximum (Carnot) efficiency more closely than Freon type heat pumps.

It is another object of the invention to reduce the cost of heat pump operation and to conserve energy.

It is another object of the invention to provide a heat pump which ventilates automatically in the process of operation.

It is another object of the invention to provide a heat pump which does not require auxiliary ventilating equipment.

It is another object of the invention to provide a heat pump/engine which is capable of efficiencies of roughly half of the theoretical maximum.

It is another object of the invention to provide an engine capable of producing power at exceptionally high efficiency using a supply of hot air at atmospheric pressure.

The invention provides a dual open cycle heat pump which operates between a cold air reservoir and a hot air reservoir and includes a heat exchanger, compressor and expander. In this case, the heat exchanger has a pair of counter-current flow paths with one flow path connected between the reservoirs to conduct a flow of air from the cold air reservoir to the hot air resrvoir. The compressor is connected between the hot air reservoir and the second flow path of the heat exchanger to compress and deliver a flow of hot air from the hot air reservoir to the second flow path and the expander is connected between the second flow path of the heat exchanger and the cold air reservoir in order to expand and deliver a flow of expanded air from the heat exchanger to the cold air reservoir.

The heat pump also includes a motor for driving the compressor and the compressor and expander may be mounted on a common shaft.

During operation as a heat pump, heat can be transferred between a mass of air outside a building (i.e. a cold air reservoir) and a mass of air inside the building (i.e. a hot air reservoir) without the need for bulky and expensive evaporators and condensers as is otherwise required by conventional Freon type heat pumps. Further, the heat pump simultaneously provides ventilation.

It is to be noted that the term "dual open cycle" is used to define the heat pump/engine since each operates with an open cycle at both ends.

Whereas in an open cycle gas turbine, the cooler is absent; in a dual open cycle engine, both the heater and cooler are absent. There is no combustor. The hot air reservoir serves as a heater and the engine configuration is chosen so that the pressure in this reservoir is the same as that in the low temperature reservoir. Temperature drops in heat exchangers are eliminated. With positive displacement compressors and expanders, very high efficiencies can be attained, not only in the engine, but also in the dual open cycle heat pump, which is the engine run backwards.

The heat pump/engine can be constructed with various supplemental features. For example, the heat pump/engine can be provided with a means to prevent fumes from lubricating oil from entering the air passing through the heat pump/engine. Also, a suitable means may be provided for adjusting the stroke volume of an expander used in the heat pump in order to insure that the power recovered from the expander is maximum. Still further, a "snowmaker preheater" can be used to prewarm very cold outside air prior to use. Finally, the heat exchanger of the equipment can be used to provide ventilation with little energy loss at times when the heat pump is not operating.

These and other objects and advantages of the invention will become more apparent from the following detailed description and appended claims taken in conjunction with the accompanying drawings in which:

Figure 1:
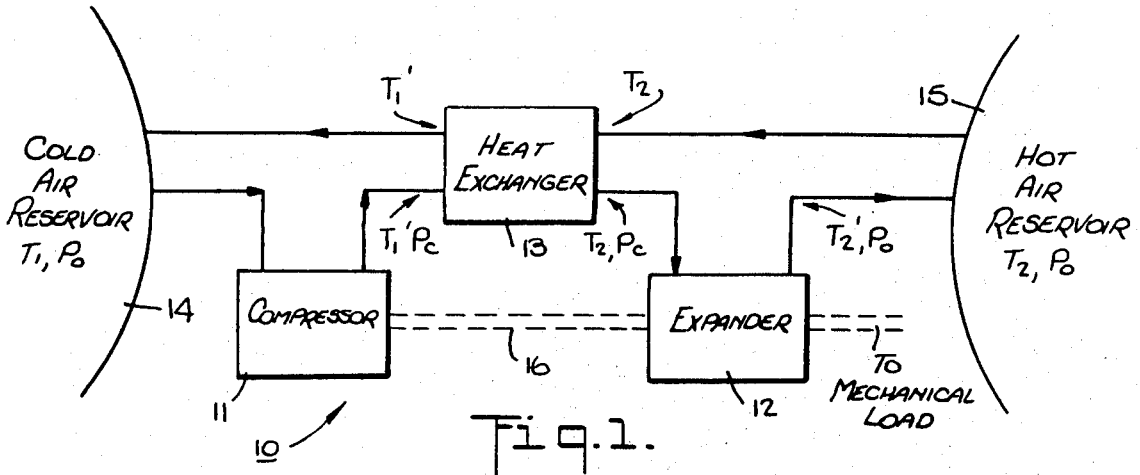
FIG. 1 illustrates a block diagram of a dual open cycle engine constructed in accordance with the invention.

Referring to FIG. 1, the dual open cycle engine 10 consists of three parts: a compressor 11, an expander 12, and a counterflow heat exchanger (recouperator or regenerator) 13. There are two basic differences between the engine and a regenerative Brayton engine. First, the engine has no combustor as a "hot space" filled with hot fresh air replaces the combustor. Second, the air is expanded prior to entry into the hot space rather than after passage through a combustor. This leads to a greater temperature difference across the heat exchanger 13, thus requiring a larger heat exchanger having a greater pressure drop. However, this is tolerated because the engine 10 is operated between hot and cold spaces in which the pressures are the same. Thus, a heat pump version of the machine can be operated open cycle at both ends ("dual open cycle") so that heat can be transferred directly between the air outside a building and that inside without the need of evaporators, condensers, or comparable structures.

Although, use is required of a counterflow heat exchanger 13, the exchanger 13 may be a regenerator in which a matrix supplies a very large heat exchange area in a compact low cost unit so that, in operation, temperature differences within the matrix are small and heat exchange almost ideal.

In discussing the principle of operation of the invention, it is convenient to assume as a first approximation that the heat exchanger 13 is perfect, such that the gas issuing from the hot end has the same temperature as that entering that end, and the same is true of the cold end.

In the engine in FIG. 1, air taken from a cold gas reservoir 14 is first compressed in the compressor 11 and thereby heated slightly from $T_1$ to $T_1'$. The air is then passed through the heat exchanger 13 and emerges with the temperature of the air entering the hot end of that exchanger 13, namely $T_2$. Next, the air is expanded in the expander 12 to a temperature $T_2'$ slightly lower than $T_2$ and discharged into a hot air reservoir 15 where the air is heated up to $T_2$. An equal amount of air from the hot air reservoir 15 is made to flow through the heat exchanger 13 in the reverse (hot or cold) direction, emerging from the heat exchanger 13 with the temperature of the air entering the cold end, namely, $T_1'$. The expander 12 and compressor 11 operate between the same two pressures. However, because the air in the expander 12 is hotter, the volume of the air and its work are also greater. Thus, with ideal expanders 12 and compressors 11, net work in available.

As illustrated, the compressor 11 and expander 12 can be mounted on a common shaft 16 which connects to a mechanical load (not shown) so as to permit the extraction of work.

Figure 2:
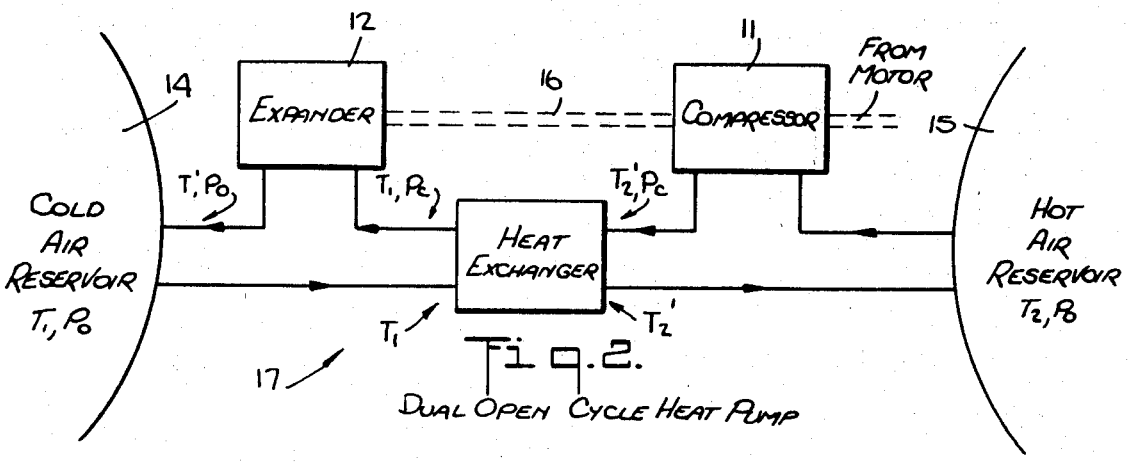
FIG. 2 illustrates a block diagram of a dual open cycle heat pump constructed in accordance with the invention.

In both the engine in FIG. 1 and the heat pump in FIG. 2, the air is compressed before passing through the heat exchanger 13. However, an alternative arrangement (not shown) is possible, the air being expanded to a sub-atmospheric pressure prior to passage through the heat exchanger. In this case, the expander is on the hot side in the engine and on the cold side in the heat pump, as before. A disadvantage of these variants is that the volume of the air expanded and compressed is larger than in the illustrated arrangements.

In order to estimate the performance of the engine it is assumed initially that the heat exchanger 13 is ideal and that the air obeys the equation $PV=n\,RT$. It is also assumed that the specific heats $c_p$ and $c_v$ are constant and hence their ratio $k=(c_p/c_v)$ is also constant. The pressure in the reservoirs is $P_o$ and the pressure after compression is $P_c$. Let $(k-1)/k=b$. Using the standard equations for adiabatic expansion or compression of a gas, the relationships for the engine of FIG. 1 are:

$$(T_2/T_2')=(P_c/P_o)^b \text{ and } (T_1'/T_1)=(P_c/P_o)^b$$

The heat $H_2$ absorbed in the hot reservoir 15 is $cp(T_2-T_2')$ while the heat $H_1$ rejected to the cold reservoir 14 is $cp(T_1'-T_1)$. The net work X per unit mass of air which circulates is $(H_2-H_1)$. Thus, the efficiency $(X/H_2)$ is given by $(T_2-T_2'-T_1'+T_1)/(T_2-T_2')$. Since $(T_2/T_2')=(T_1'/T_1)$, this reduces to $n_t=(T_2'-T_1)/T_2'$ where $n_t$ is $(X/H_2)$, the thermodynamic efficiency. This is exactly the same as the expression for the Carnot limit except that $T_2'$ has been substituted for $T_2$. Thus, so long as $T_2'$ is not too much smaller than $T_2$, i.e. the pressure ratio is not too great, the thermodynamic efficiency will approach the Carnot efficiency.

Although recouperators of the counterflow type can, in principle, be used, those of realistic size do not have as much surface area for heat transfer as is desirable, and regenerative exchangers with their much larger heat transfer areas are preferable. These consist typically of a stack of a large number of disks of wire screen. The temperature inside this matrix decreases continuously as one passes from the hot to the cold end. In a real (rather than ideal) unit there is a temperature difference ($\Delta T$) between air and matrix. It is this difference that propels the heat transfer. Thus, in the arrangement in FIG. 1, air emerges from the regenerator matrix at a temperature of ($T_2-2(\Delta T)$) at the hot end and ($T_1'+2(\Delta T)$) at the cold end, the hot end matrix being at a temperature ($T_2-\Delta T$) and the cold end at a temperature of ($T_2-2(\Delta T)$) while the same amount enters the hot end at temperature $T_2$, then there will be a net loss of heat at the hot end of $2c_pM$ ($\Delta T$) and an equal heat gain in the cold reservoir 14. This amounts to a heat leak between the reservoirs. If the mass flow M and the temperature difference ($\Delta T$) of the regenerator are known, the heat leak is also known. The engine can be viewed as operating in an ideal fashion between reservoirs having the same temperatures as the ends of the matrix with a heat leak of this amount superimposed.

Energy is also lost in piston ring friction, internal friction in the flexible materials used for diaphragms, and friction in bearings cams and bearings. Pressure drops in valve ports, air ducts, and leakage of air by rings and seals also reduce efficiency. In the engine, these losses are conveniently dealt with in terms of an overall factor $n_e$ such that the actual mechanical output of the engine X' is given by $X'=n_e(X-F)$ where F is the power needed to overcome the pressure drop in the regenerator. It will be assumed that in a well constructed engine $n_e$ is 0.8. In heat pumps, a similar equation is used with the actual mechanical input X' required being given by $X'=n_h(X+F)$ where $n_h$ for a well designed heat pump will be taken to be 1.2.

The power (watts) lost in regenerator pressure drop is ($\Delta P$) V where ($\Delta P$) is the presure drop (newtons/$m^2$) and V is the volume of air ($m^3$) which passes through the regenerator per second in one way or the other.

Figure 3:
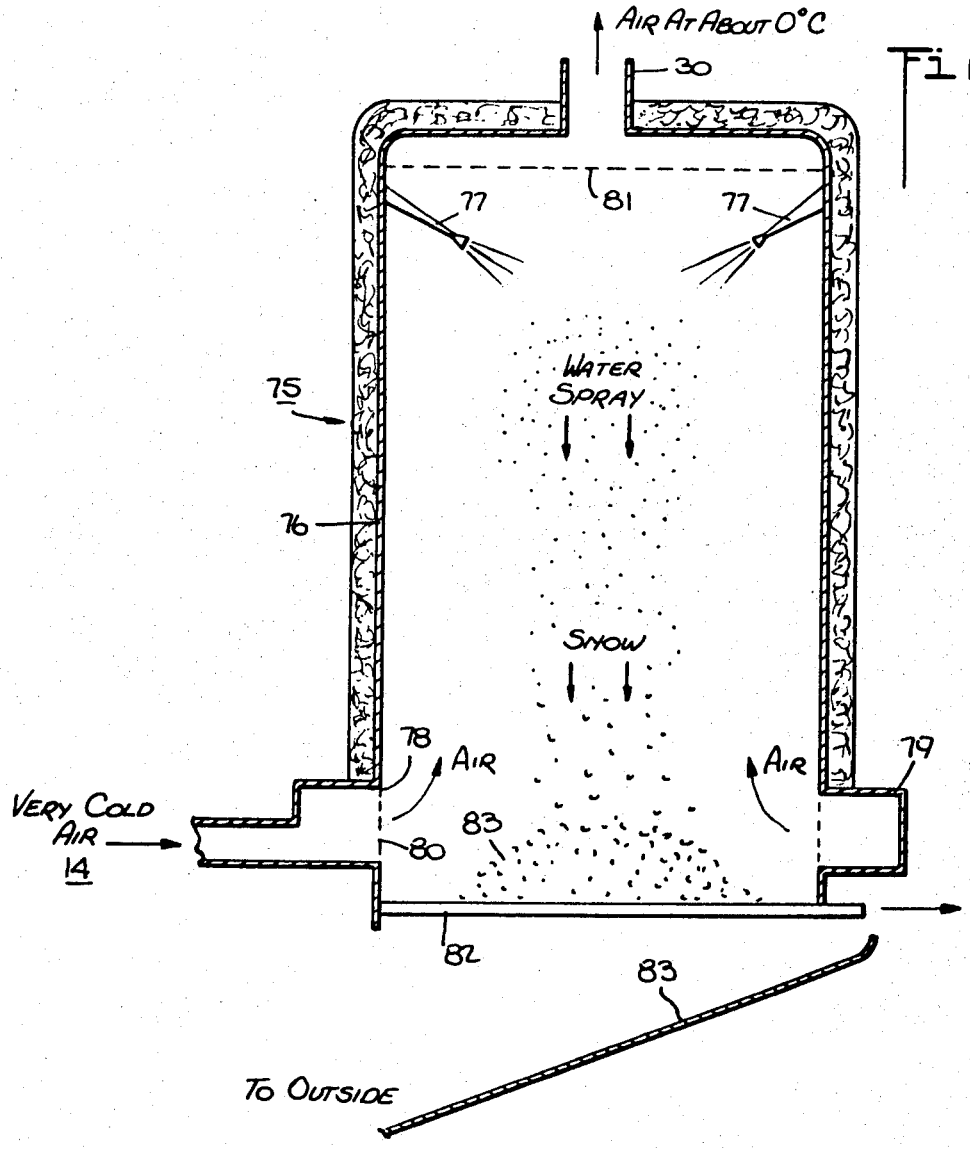
FIG. 3 illustrates a snowmaker preheater utilized by a heat pump/engine according to the invention.

Referring to FIG. 3, in very cold climates such as in Alaska, the heat pump may be capable of COP's exceeding the theoretical limit. To this end, the heat pump is provided with a "snow maker preheater" 75. This preheater 75 is constructed of a large vertically disposed tube 76 which is located between the cold air reservoir 14 and the heat exchanger (not shown) and a means, such as nozzles 77, for fine spraying water into the tube 76 at the upper end.

The tube 75 is provided with a circumferentially disposed inlet 78 at the lower end which communicates with a circumferential air duct 79 to receive a flow of cold air from the cold air reservoir 14. As indicated, a perforated screen 80 is disposed across the inlet 78. In addition, a perforated screen 81 is disposed across the upper end of the tube 76 for diffusing the flow of cold air leading to the duct 30 at the upper end of the tube 76.

During operation, cold air flows into the tube 76 via the air duct 79 and inlet 78. This air then flows relatively slowly upwardly towards the duct 30. During this time, water is sprayed into the tube 76 via the nozzles 77. The fine spray which emanates from the nozzle 77 then freezes as the spray drifts downward. At the same time, a heat exchange is effected between the water and the upward flow of cold air causing the air temperature to rise to that of freezing water, i.e. 32° F. or 273° K. Thus, if the outside air is, for example, minus 50° F., the temperature of the air will be raised by the preheater 75 to 32° F. and the heat pump will operate between 32° F. and that inside the building rather than minus 50° F.

The preheater 75 requires a source of water in order to provide the water for heating the cold air flow. Each gallon of water supplies roughly one third of a kilowatt-hour of thermal energy. Thus, nine gallons of water will supply three kilowatt hours of heat.

It is to be noted that the tube 76 may be of a cylindrical cross-section or may be of any other suitable cross-section.

In order to prevent the water spray and snow from being carried by local rapid updrafts in the enclosure to the outlet duct 30, the air throughout the tube 76 flows upward at a more or less uniform rate. The space within the tube 76 must of course be protected from outside winds. In addition, the wire screen 81 across the top of the tube 76 will act as a "diffuser" and enhance the uniformity of the upflow velocity of the air. By control of the sizes of the nozzle orifices through which the water is sprayed, drop sizes are adjusted so that they are small enough to freeze before reaching the bottom of the tube 76 but large enough to sink at a speed relative to the surrounding air which is greater than the upflow velocity of the air. This dual objective can always be achieved by use of a tube 76 which is high enough to give drops time to freeze as they fall, and big enough to reduce the upflow velocity to a reasonably small value, e.g. 1 foot/sec. Thus, for an enclosure 8 feet high having a cross-section of 3.2 by 3.2 feet, the flow rate would be 10 cubic feet/second and a drop of the spray, falling at 1.5 feet per second in still air and released in the tube 76 at a height of six feet, would have 12 seconds to fall before hitting the floor 82 of the preheater.

The speed "$\nu$" in meters/second is related to drop diameter "a" in meters by the well known Stokes formula $\nu=mg/6\pi\eta a$ where "m" is the drop mass, "g" the gravitational constant, and "$\eta$" the viscosity of air.

The floor 82 can be constructed so as to be moved or withdrawn sideways ever so often (e.g. every hour). The tube wall then acts to scrape off the snow 83 which then falls through a chute 82 to the outdoors. The resultant snow pile can be swept or shoveled away as need be or the snow from the chute can be distributed by a "snowblower" mechanism. Periodic warming of the inside walls of the tube 76 will release any frost which has formed thereon.

Should the expander 12 and compressor 11 use lubricated rings, oil fumes in the interspace between piston and cylinder walls can be bled off through the use of a "fume groove" (not shown) just above the rings. In this case, the piston wall is pierced with one or more pinholes, such that air in the interspace flows slowly downwards and exits to the crankcase. This requires that the average pressure of the air in the cylinder be greater than atmospheric.

The invention thus provides a heat pump in which downflow air is compressed, passed through the heat exchanger, expanded and discharged into the cold reservoir, while upflow air is passed through a snowmaker preheater and the heat exchanger without pressure change. Alternatively, upflow air can be expanded, then passed through the heat exchanger, then compressed, then discharged into the hot reservoir, while downflow air passes through the heat exchanger in the reverse direction without pressure change.

What is claimed is:

1. In combination, a cold air reservoir for air at a first temperature and pressure;

a hot air reservoir for receiving air at a second temperature greater than said first temperature;

a preheater including a vertically disposed tube having an inlet at a lower end to receive a flow of cold air from said cold air reservoir at a temperature below freezing and means for fine spraying water into said tube at an upper end to effect a heat exchange between the water and the flow of cold air to freeze the water into snow and to heat the air; and a heat exchanger connected to an upper end of said tube of said preheater to receive the air heated in said tube and to said hot air reservoir to deliver the heated air thereto.

2. The combination as set forth in claim 1 which further comprises a movable floor in said tube at said lower end for receiving snow thereon and a chute below said floor to receive a discharge of snow from said tube.

3. The combination as set forth in claim 1 wherein said inlet is circumferentially disposed about said tube.

4. The combination as set forth in claim 1 which further comprises a screen at said upper end of said tube for diffusing the flow of cold air.

5. The combination as set forth in claim 1 which further comprises a duct connected to said upper end of said tube to receive a pre-heated flow of cold air from said tube for delivery to said heat exchanger.

* * * * *